US011660882B2

(12) United States Patent
Daigo

(10) Patent No.: US 11,660,882 B2
(45) Date of Patent: May 30, 2023

(54) IMAGE FORMING APPARATUS INCLUDING JAM DETECTION PART PROVIDED WITH PHOTOELECETRIC SENSOR

(71) Applicant: KYOCERA Document Solutions Inc., Osaka (JP)

(72) Inventor: Hironori Daigo, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/486,314

(22) Filed: Sep. 27, 2021

(65) Prior Publication Data

US 2022/0097415 A1 Mar. 31, 2022

(30) Foreign Application Priority Data

Sep. 28, 2020 (JP) ..... JP2020-162191

(51) Int. Cl.
*B41J 11/00* (2006.01)
*B41J 29/17* (2006.01)

(52) U.S. Cl.
CPC ..... *B41J 11/006* (2013.01); *B41J 11/0095* (2013.01); *B41J 29/17* (2013.01); *B41J 11/009* (2013.01)

(58) Field of Classification Search
CPC ..... B41J 11/006; B41J 11/0095; B41J 29/17; B41J 11/009
See application file for complete search history.

(56) References Cited

U.S. PATENT DOCUMENTS

2020/0106914 A1* 4/2020 Sawai ..... H04N 1/0285

FOREIGN PATENT DOCUMENTS

JP S50-152739 A 12/1975

* cited by examiner

*Primary Examiner* — Henok D Legesse
(74) *Attorney, Agent, or Firm* — Studebaker & Brackett PC

(57) ABSTRACT

An image forming apparatus includes a photoelectric sensor and a controller. The photoelectric sensor emits light to an object to be detected, receives the light reflected on the object and outputs an electric signal corresponding to a quantity of the reflected light. The object includes a facing surface area and a sheet on the facing surface area. The controller detects whether the sheet exists on the facing surface area in accordance with an output of the photoelectric sensor. The controller stores, as a threshold of the output of the photoelectric sensor, a first threshold for determining that the sheet does not exist on the facing surface area and a second threshold for determining that the sheet exists on the facing surface area, and determines that the facing surface area is contaminated when the output of the photoelectric sensor is within a range between the first threshold and the second threshold.

7 Claims, 14 Drawing Sheets

IMAGE FORMING APPARATUS INCLUDING JAM DETECTION PART PROVIDED WITH PHOTOELECETRIC SENSOR

INCORPORATION BY REFERENCE

This application is based on and claims the benefit of priority from Japanese patent application No. 2020-162191 filed on Sep. 28, 2020, which is incorporated by reference in its entirety.

BACKGROUND

The present disclosure relates to an image forming apparatus which forms an image on a sheet.

An apparatus in which a document is read by a reading device disposed below a target glass while the document passes a document conveyance path is known. In the apparatus, by passing a cleaning sheet in place of the document through the document conveyance path, the target glass (the document conveyance path) is cleaned.

However, in the above-described technique, it is difficult to know a cleaning time for the target glass (the document conveyance path). Therefore, in the above-described technique, the cleaning operation can be performed only after the occurrence of reading failure or conveyance failure of the document.

SUMMARY

In accordance with an aspect of the present disclosure, an image forming apparatus includes a reflective photoelectric sensor and a controller. The reflective photoelectric sensor emits light to an object to be detected, receives the light reflected on the object and outputs an electric signal corresponding to a quantity of the reflected light. The object to be detected includes a facing surface area and a sheet on the facing surface area. The controller detects whether the sheet exists on the facing surface area in accordance with an output of the photoelectric sensor. The controller stores, as a threshold of the output of the photoelectric sensor, a first threshold for determining that the sheet does not exist on the facing surface area and a second threshold for determining that the sheet exists on the facing surface area, and determines that the facing surface area is contaminated to cause decreasing in the quantity of reflected light when the output of the photoelectric sensor is within a range between the first threshold and the second threshold.

The other features and advantages of the present disclosure will become more apparent from the following description. In the detailed description, reference is made to the accompanying drawings, and preferred embodiments of the present disclosure are shown by way of example in the accompanying drawings.

DETAILED DESCRIPTION

Figure 1:
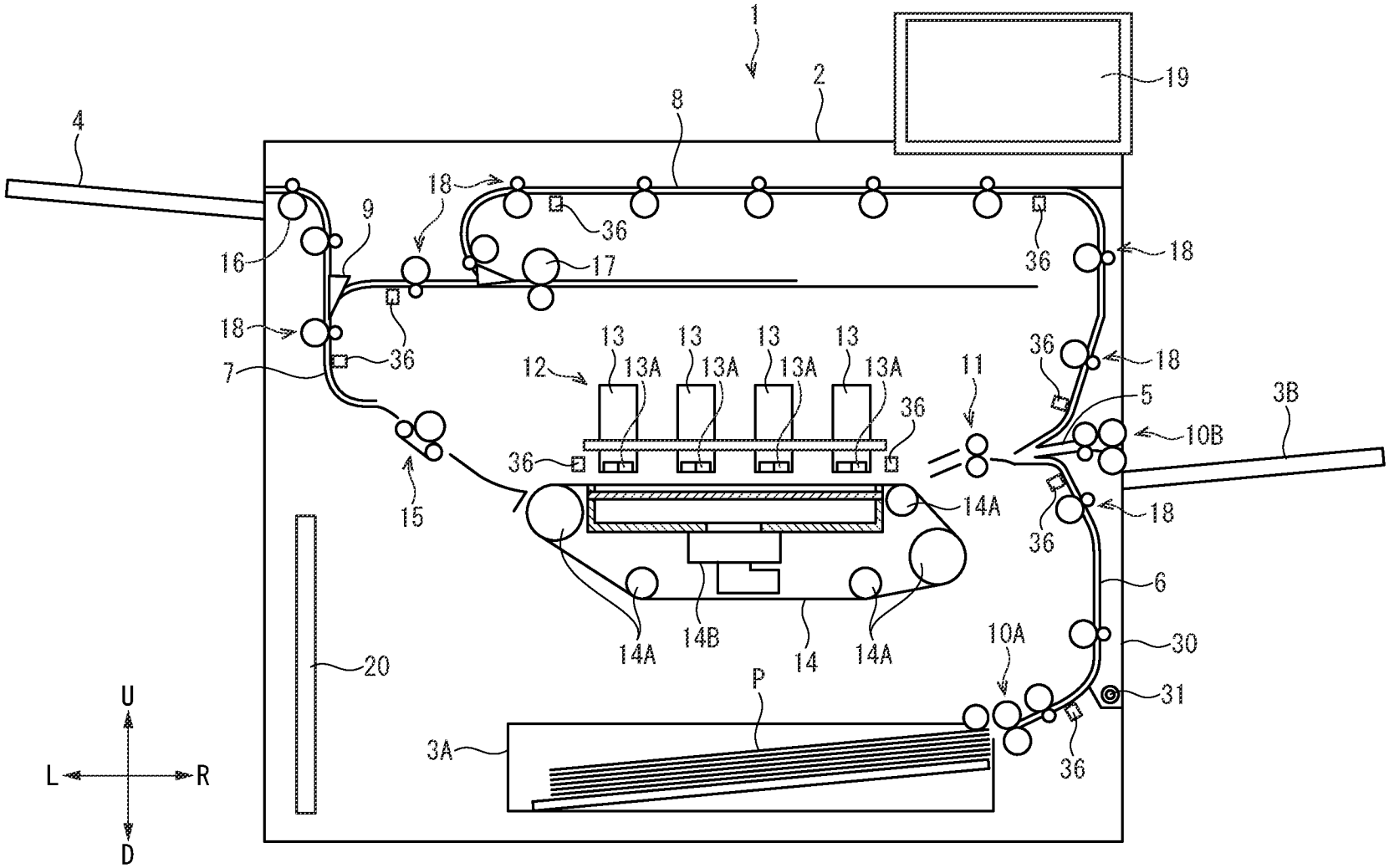
FIG. 1 is a sectional view schematically showing an image forming apparatus according to one embodiment of the present disclosure.

Hereinafter, with reference the attached drawings, one embodiment of the present disclosure will be described. "L", "R", U" and "D" marked in the drawings respectively show "left", "right", "upper" and "lower". In these drawing, a front side of the paper surface on which the drawings are drawn is defined as "a front side". In the specification, although the terms showing a direction and a position are used, they are used only for convenience of explanation and does not limit the technical scope of the present disclosure.

[Outline of Image Forming Apparatus]

Figure 2:
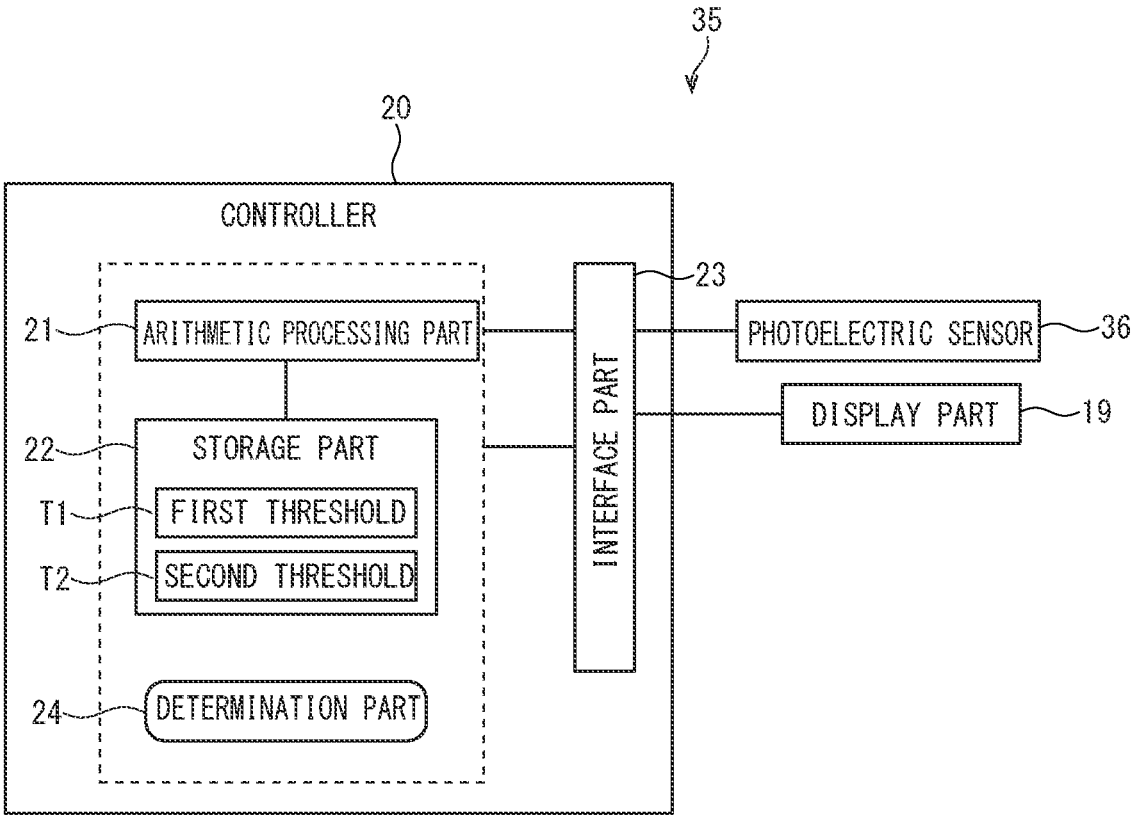
FIG. 2 is a block diagram showing a controller and the others of the image forming apparatus according to the embodiment of the present disclosure.
Figure 3:
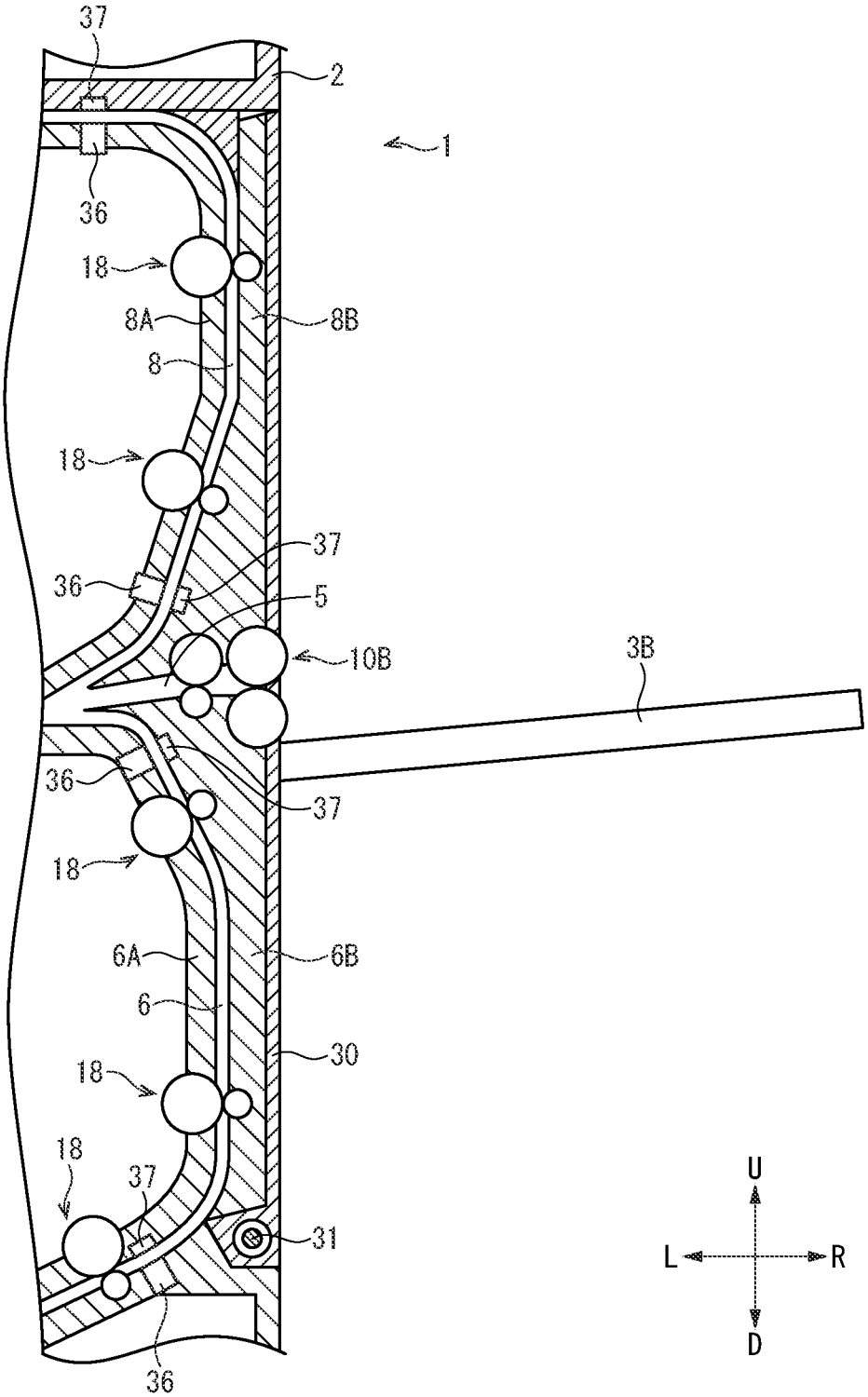
FIG. 3 is a sectional view showing a part of a right side portion of the image forming apparatus according to the embodiment of the present disclosure.

With reference to FIG. 1 to FIG. 3, an image forming apparatus 1 will be described. FIG. 1 is a view (a front view) schematically showing an inner structure of the image forming apparatus 1. FIG. 2 is a block diagram showing a controller 20 and the others of the image forming apparatus 1. FIG. 3 is a sectional view showing a part of the right side portion of the image forming apparatus 1.

The image forming apparatus 1 is an inkjet type color printer in which an ink droplet is ejected to form an image on a sheet P. As shown in FIG. 1, the image forming apparatus 1 includes a box-shaped housing 2. In the lower portion of the housing 2, a sheet feeding cassette 3A in which the sheet P is placed is stored, and a manual sheet feeding tray 3B on which the sheet P is manually placed is provided on the right side surface of the housing 2. On the upper portion of the left side surface of the housing 2, a sheet discharge tray 4 on which the image formed sheet P is stacked is provided.

In the right side portion in the housing 2, a first conveyance path 6 along which the sheet P is conveyed from the sheet feeding cassette 3A to an image forming part 12 provided substantially in the center portion of the housing 2 is formed. On the upstream portion of the first conveyance path 6, a sheet feeding part 10A is provided, and on the downstream portion of the first conveyance path 6, a registration roller 11 is provided. The downstream end of the first conveyance path 6 is connected to a sheet feeding path 5 of the manual sheet feeding tray 3B, and on the sheet feeding path 5, a sheet feeding part 10B is provided. The sheet feeding part 10A has a function of feeding the sheet P from the sheet bundle placed in the sheet feeding cassette 3A, and the sheet feeding part 10B has a function of feeding the sheet P from the sheet bundle placed on the manual sheet feeding tray 3B.

The image forming part 12 is provided with a plurality of (for example, four) line heads 13 for ejecting the ink droplets. Each line head 13 has a plurality of ejection heads 13A corresponding to each of the inks of black, cyan, magenta and yellow. Each ejection head 13A has a nozzle surface (not shown) to which a plurality of ejection nozzles (not shown) is opened, and ejects the ink (a liquid) from the ejection nozzles. Each ejection head 13A communicates with an ink pack (not shown) containing the ink of each color via a tube (not shown), and the ink is supplied from the ink pack to the ejection head 13A.

A conveyance belt 14 is stretched around a plurality of stretching rollers 14A disposed below the image forming part 12. A plurality of through-holes (not shown) is formed in the conveyance belt 14, and a suction part 14B for generating a negative pressure in the through-holes of the conveyance belt 14 at a position facing the image forming part 12 is disposed inside the conveyance belt 14. On the left side (on the downstream side in the conveyance direction) of the image forming part 12, a decurl device 15 is provided for correcting the curl of the sheet P by conveying the sheet P while holding the sheet P therebetween.

In the left side portion in the housing 2, a second conveying path 7 along which the sheet P is conveyed from the decurl device 15 toward the sheet discharge tray 4 is formed. A branch member 9 is provided in the middle of the second conveyance path 7, and a sheet discharge part 16 is provided on the downstream portion of the second conveyance path 7. The branch member 9 switches the discharge destination of the sheet P to the sheet discharge tray 4 and to a third conveyance path 8 described later. The sheet discharge part 16 has a function of discharging the image-formed sheet P to the sheet discharge tray 4.

In the upper portion in the housing 10, the third conveyance path 8 along which the sheet P is conveyed from the branch member 9 in the middle of the second conveyance path 7 to the registration roller 11 is formed. In the middle of the third conveyance path 8, an inversion part 17 for tuning the sheet P upside down is provided.

On the first to the third conveyance paths 6 to 8, a plurality of conveyance rollers pairs 18 for conveying the sheet P is provided. One of the conveyance rollers pair 18 is a drive roller which is rotationally driven by receiving a driving force from a motor or the like, and the other of the conveyance rollers pair 18 is a driven roller which rotates as the drive roller rotates (not shown). The conveyance rollers pair 18 is rotated while holding the sheet P to convey the sheet P toward the downstream side of the first to the third conveyance paths 6 to 8.

The image forming apparatus 1 is provided with a display part 19 which displays various information to a user or the like. The display part 19 is attached, for example, on the right upper portion of the front side surface of the housing 2. The display part 19 is a so-called touch panel, and is a display device for displaying information (character string, picture, etc.) and also an input device for allowing the user or the like to input or select information by being touched by the user. Around the display part 19, an input part such as a button is provided (not shown). The display part 19 is not limited to the touch panel, but may be a liquid crystal display or the like.

The image forming apparatus 1 (inside the housing 2) is provided with a controller 20 which suitably controls various control target devices. As shown in FIG. 2, the controller 20 includes an arithmetic processing part 21, a storage part 22 and an interface part 23. The arithmetic processing part 21, the storage part 22 and the interface part 23 are electrically connected to each other.

The arithmetic processing part 21 is a processer executing various arithmetic processing according to program and data stored in the storage part 22. The storage part 2 contains a random access memory (RAM), a read only memory (ROM) and an auxiliary storage device such as a semiconductor drive. The storage part 22 stores the program and the data used in the image forming apparatus 1. To the interface part 23, the control target devices such as the image forming part 12 and the display part 19 are electrically connected. To the interface part 23, an external terminal such as a personal computer is connected via a network or the like (not shown). The controller 20 may be achieved by a logic circuit mounted on an integral circuit board (a hardware) in place of the processer executing the program.

[Image Forming Processing]

With reference to FIG. 1, the image forming processing performed by the image forming apparatus 1 will now be described. The controller 20 appropriately controls the various control target devices and performs the image forming processing as follows.

The sheet feeding parts 10A and 10B send the sheet P fed from the sheet feeding cassette 3A or the manual sheet feeding tray 3B to the first conveyance path 6 or the sheet feeding path 5. The registration roller 11 performs a skew correction by temporarily blocking the sheet P (for one-side printing), and sends the sheet P to the conveyance belt 14 before printing in accordance with the ejection timing of ink droplets from the line head 13. The sheet P is attracted on the conveyance belt 14 and conveyed to the downstream side by traveling the conveyance belt 14. The image forming part 12 (the line heads 13) ejects the ink droplets on the sheet P on the conveyance belt 14 to form a full-color image on the sheet P (print). The sheet P passing below the image forming part 12 is released from being attracted on the conveyance belt 14 and is sent to the decurl device 15. The decurl device 15 corrects the curl generated on the sheet P.

When the one-side printing is to be performed, the branch member 9 opens the second conveyance path 7 and closes the third conveyance path 8. The sheet P printed on one side is discharged to the discharge tray 4 through the second conveyance path 7.

When the both-side printing is to be performed, the branch member 9 closes the second conveyance path 7 and opens the third conveyance path 8. The sheet P printed on one side enters the third conveyance path 8, is turned upside down in the inversion part 17, and is conveyed toward the registration roller 11 again. Thereafter, an image is formed on the back surface of the sheet P in the same order as in the above-described one-side printing, and the curl of the sheet P printed on both sides is collected and discharged to the sheet discharge tray 4.

[Structure for Treating of Jam]

By the way, the sheet P being conveyed may be jammed in the middle of the first to the third conveyance paths 6 to 8. The housing 2 is provided with an openable/closable door or the like for removing the sheet P jammed in the first to the third conveyance paths 6 to 8.

As shown in FIG. 1, as an example of the door or the like, a cover 30 for removing the sheet P jammed in the first conveyance path 6 or the third conveyance path 8 is attached to the right side surface of the housing 2 in an openable and closable manner. The cover 30 is turned around a turning shaft 31 provided horizontally in the lower end portion. The cover 30 and the housing 2 are provided with a locking structure (not shown) for fixing the closed cover 30, and the cover 30 is provided with a lever (not shown) for releasing the locking of the cover 30. The user pulls the lever to release the locking of the cover 30, rotates and opens the closed cover 30 around the turning shaft 31, opens the first conveyance path 6 and the third conveyance path 8, and removes the jammed sheet P (performs the jam treatment).

As shown in FIG. 3, on the inner surface of the cover 30, opposite side conveyance members 6B and 8B constituting a part of the first conveyance path 6 and the third conveyance path 8 are provided. The opposite side conveyance members 6B and 8B face main body side conveyance members 6A and 8A provided inside the housing 2 with a gap in a state where the cover 30 is closed. The gaps formed between the main body side conveyance members 6A and 8A and the opposite side conveyance members 6B and 8B serve as the first and the third conveyance paths 6 and 8. For example, the drive roller of the conveyance rollers pair 18 is supported by the main body side conveyance members 6A and 8A, and the driven roller of the conveyance rollers pair 18 is supported by the opposite side conveyance members 6B and 8B.

[Jam Detection Part]

Figure 4:
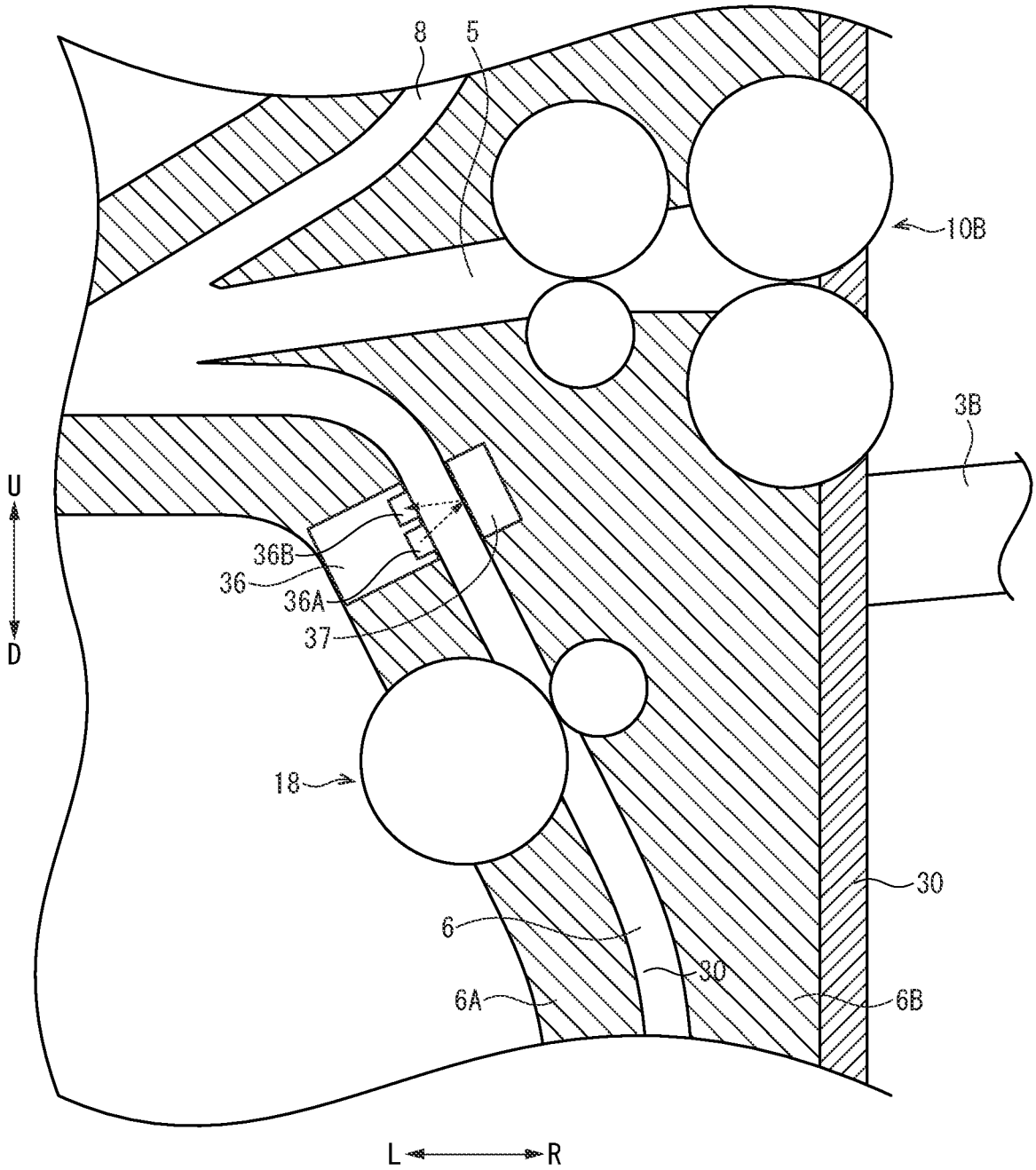
FIG. 4 is an enlarged sectional view showing a downstream side portion of a first conveyance path in the image forming apparatus according to the embodiment of the present disclosure.
Figure 5:
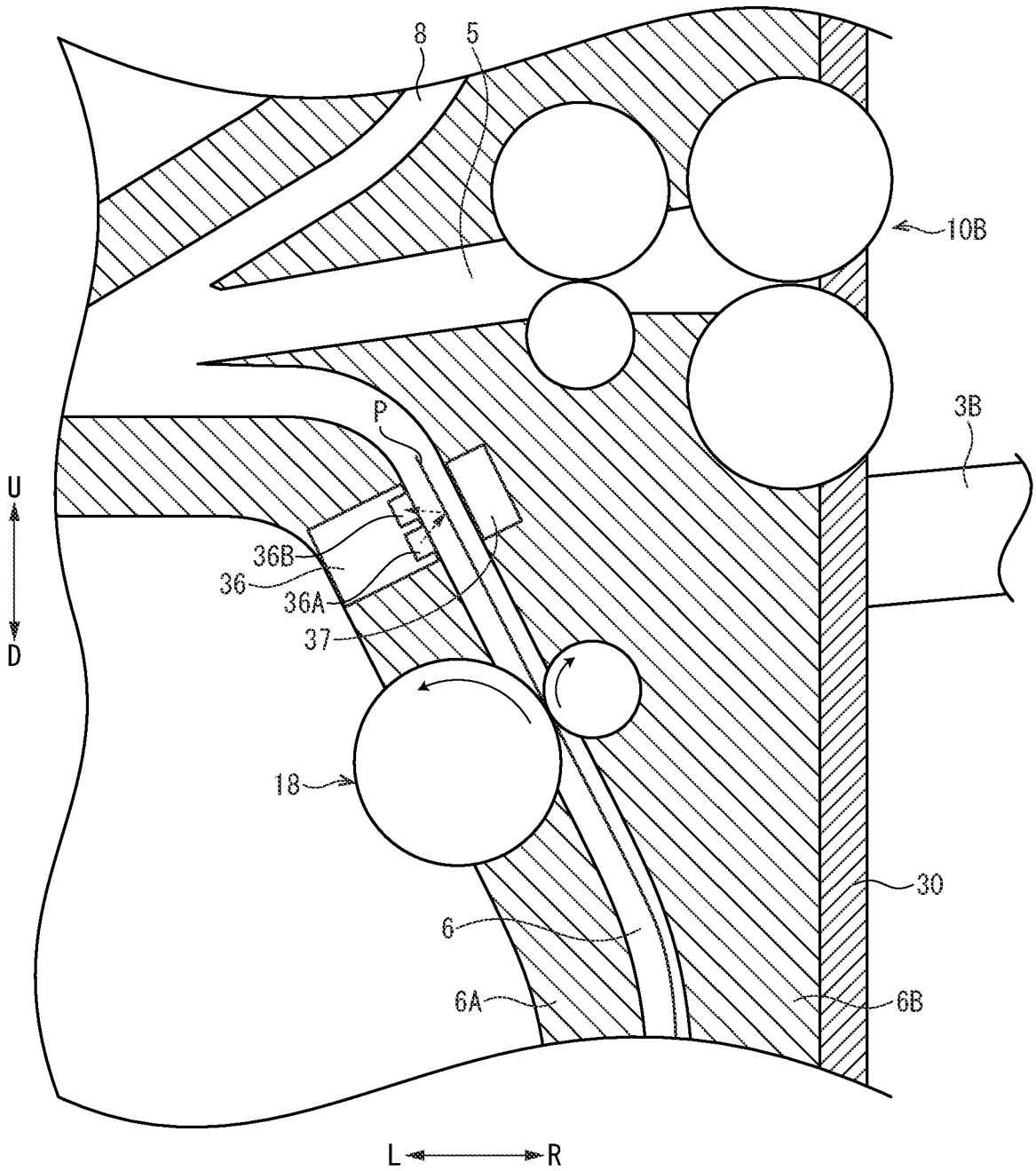
FIG. 5 is an enlarged sectional view showing the downstream side portion (during the sheet conveying) of the first conveyance path in the image forming apparatus according to the embodiment of the present disclosure.
Figure 6:
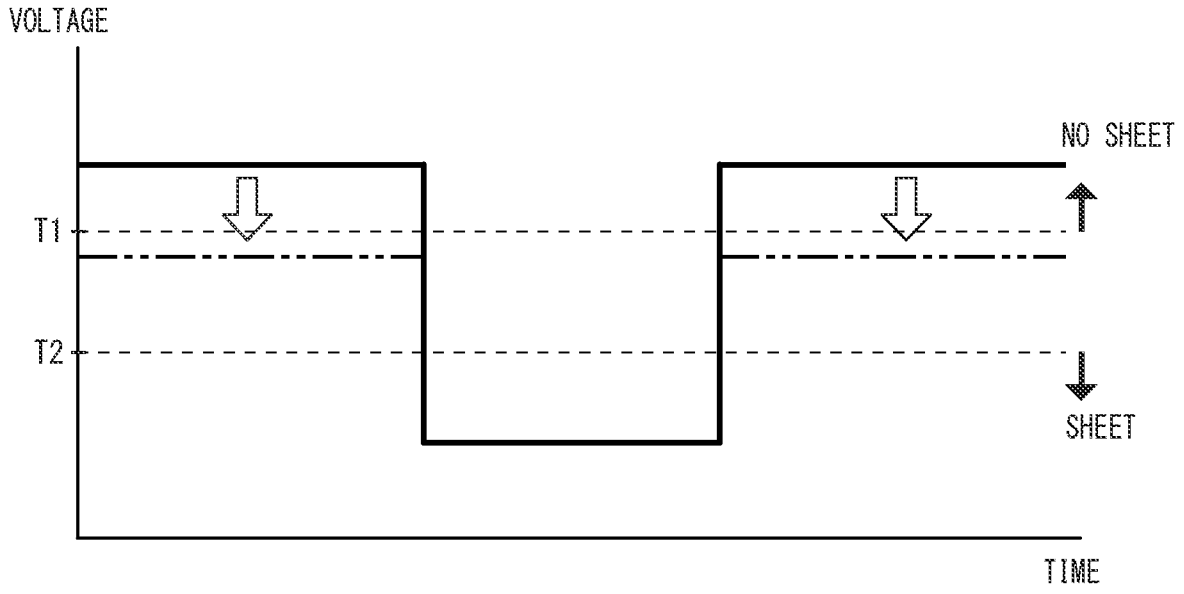
FIG. 6 is a graph showing an output of a photoelectric sensor in the image forming apparatus according to one embodiment of the present disclosure.

The image forming apparatus 1 is provided with a jam detection part 35 which detects that the sheet P is jammed on the first to the third conveyance paths 6 to 8 and the conveyance belt 14 (jam). Hereinafter, with reference to FIG. 1 to FIG. 6, the jam detection part 35 will be described. FIG. 4 is an enlarged sectional view showing the downstream side portion of the first conveyance path 6. FIG. 5 is an enlarged sectional view showing the downstream side portion of the first conveyance path 6 (during the conveying of the sheet S). FIG. 6 is a graph showing an output of a photoelectric sensor 36.

As shown in FIG. 2, the jam detection part 35 is constituted by a plurality of photoelectric sensors 36 and the controller 20. The photoelectric sensors 36 have the same structure, and one photoelectric sensor 36 provided on the downstream side of the first conveyance path 6 will be describe mainly. FIG. 2 shows one photoelectric sensor 36.

<Photoelectric Sensor>

As shown in FIG. 1, the photoelectric sensors 36 are disposed at suitable positions (for example, near the conveyance rollers pair 18) on the first to the third conveyance paths 6 to 8. The photoelectric sensors 36 are provided at positions facing the conveyance belt 14 on the upstream side and on the downstream side of the image forming part 12 in the conveyance direction. The photoelectric sensors 36 are electrically connected to the interface part 23 via an analog-to-digital conversion circuit (not shown) (see FIG. 2). The photoelectric sensor 36 emits light toward an object to be detected, receives the reflected light reflected by the object to be detected, and outputs an electric signal (a voltage) corresponding to a quantity of the reflected light. More specifically, the photoelectric sensor 36 is a reflective type analog sensor having a light emitting part 36A for emitting the light and a light receiving part 36B for receiving the reflected light (see FIG. 4), and outputting a voltage that changes depending on an increase or decrease in the quantity of reflected light (the quantity of received light). The photoelectric sensor 36 decreases the voltage as the quantity of received light (the quantity of reflected light) increases (see FIG. 6). That is, the increase or decrease in the output (the voltage) of the photoelectric sensor 36 is inversely proportional to the increase or decrease in the quantity of received light (the quantity of reflected light).

In the specification, the term "an object to be detected" includes a facing surface area and the sheet P on the facing surface area. Also, in the specification, the term "the facing surface area" includes a plurality of path facing surface areas 37 provided at suitable positions on the conveyance belt 14 (see FIG. 1) and on the first to the third conveyance paths 6 to 8. In the present specification, for convenience of explanation, the conveyance belt 14 and the path facing surface areas 37 are collectively referred to as "the path facing surface area or the others 37".

As shown in FIG. 3, each of the path facing surface areas 37 is provided at a position facing the photoelectric sensor 36. Each path facing surface area 37 is formed on a member constituting the first to the third conveyance paths 6 to 8, and has a plane substantially parallel to the light emitting part 36A and the light receiving part 36B of the photoelectric sensor 36. Some of the path facing surface areas 37 are provided on the opposite side conveyance members 6B and 8B of the cover 30, and some of the photoelectric sensors 36 are provided on the main body side conveyance members 6A and 8A facing the opposite side conveyance members 6B and 8B.

The conveyance belt 14 and the path facing surface areas 37 are processed to suppress reflection of light. For example, the conveyance belt 14 is colored in a dark color so as to suppress reflection of light (not shown). For example, a nonwoven fabric or the like is attached to the plane of the path facing surface area 37 (not shown). The plane of the path facing surface area 37 may be colored in a dark color like the conveyance belt 14.

Although the photoelectric sensor 36 is provided on the upstream side and on the downstream side of the image forming part 12, the photoelectric sensor 36 may be provided only on either the upstream side or the downstream side of the image forming part 12. The photoelectric sensor 36 may be provided between the line heads 13 adjacent to each other in the conveyance direction (not shown). It is sufficient that at least one photoelectric sensor 36 is provided in the first to the third conveying paths 6 to 8.

<Controller>

The controller 20 determines the presence or absence of the sheet P on the path facing surface area or the others 37 in accordance with the output of the photoelectric sensor 36. The storage part 22 of the controller 20 stores a threshold value of the output of the photoelectric sensor 36. More specifically, as shown in FIG. 2, the storage part 22 stores (records) a first threshold T1 for determining that the sheet P does not exist on the path facing surface area or the others 37, and a second threshold T2 for determining that the sheet P exists on the path facing surface area or the others 37. The first threshold T1 is set to a value higher than the second threshold T2 (see FIG. 6). In the present specification, the expression "the sheet P exists (does not exist) on the path facing surface area or the others 37 (on the facing surface area)" means that the sheet P actually exists (does not exist) on the path facing surface area or the others 37, and also includes that the sheet P faces (does not face) so as to cover the path facing surface area 37 from the lower side or from the lateral side.

The controller 20 includes a determination part 24 for determining the presence or absence of the sheet P by comparing the electric signal (the voltage) output from the photoelectric sensor 36 with each of the thresholds T1 and T2 stored in the storage part 22. The determination part 24 is provided as a function of the controller 20, and is realized by the arithmetic processing part 21 executing arithmetic processing according to the program and the data stored in the storage part 22.

[Output of Photoelectric Sensor]

For example, as shown in FIG. 4, when the sheet P does not exist on the path facing surface area or the others 37, the light emitted from the light emitting part 36A of the photoelectric sensor 36 is reflected by the path facing surface area or the others 37, and the reflected light is incident on the light receiving part 36B of the photoelectric sensor 36. Since the path facing surface area or the others 37 is processed to suppress reflection of light, the quantity of reflected light is very small. Accordingly, the photoelectric sensor 36 outputs a voltage equal to or larger than the first threshold T1 which indicates that the sheet P does not exist on the path facing surface area or the others 37 (see the solid line shown in FIG. 6). In FIG. 6, for convenience of explanation, the output (the voltage) of the photoelectric sensor 36 is shown by the straight line, but actually, since the photoelectric sensor 36 is an analog sensor, the output of the photoelectric sensor 36 has an irregularly oscillating waveform.

On the other hand, as shown in FIG. 5, when the sheet P exists on the path facing surface area or others 37, the light emitted from the light emitting part 36A of the photoelectric sensor 36 is reflected by the sheet P, and the reflected light is incident on the light receiving part 36B of the photoelectric sensor 36. Since the sheet P reflects the light easily than the path facing surface area or the others 37, the quantity of reflected light at this time is larger than the quantity of reflected light when reflected by the path facing surface area or the others 37. Accordingly, the photoelectric sensor 36 outputs a voltage equal to or lower than the second threshold value T2 indicating that the sheet P exists on the path facing surface area or the others 37 (see the solid line shown in FIG. 6). The determination part 24 determines whether a predetermined time elapses after the output of the voltage of the second threshold T2 or less, and determines that a sheet jam has occurred if the voltage of the second threshold T2 or less has been output even after the predetermined time is elapsed. A timer function for measuring the time is provided as a function of the controller 20. The predetermined time for the sheet jam determination is preset and stored in the storage part 22.

By the way, when the image forming processing is repeated, the conveyance belt 14 and the path facing surface area 37 may become dirty with paper powder, ink, or the like, the quantity of reflected light on the path facing surface area or the others 37 may be increased, and the output of the photoelectric sensor 36 may be decreased (see the blank arrow in FIG. 6). Then, as shown by the two-dot chain line in FIG. 6, the photoelectric sensor 36 may output a voltage lower than the first threshold T1 and higher than the second threshold T2. When the output of the photoelectric sensor 36 is within a range between the first threshold T1 and the second threshold T2, the determination part 24 determines that the path facing surface area or the others 37 is contaminated to decrease the quantity of reflected light. That is, the value within the range between the first threshold T1 and the second threshold T2 includes a threshold indicating that maintenance of the path facing surface area or the others 37 is required. The maintenance of the path facing surface area or the others 37 shows, for example, cleaning of the path facing surface area or the others 37 or replacement of the path facing surface area or the others 37.

[Jam Detection Method]

Figure 7:
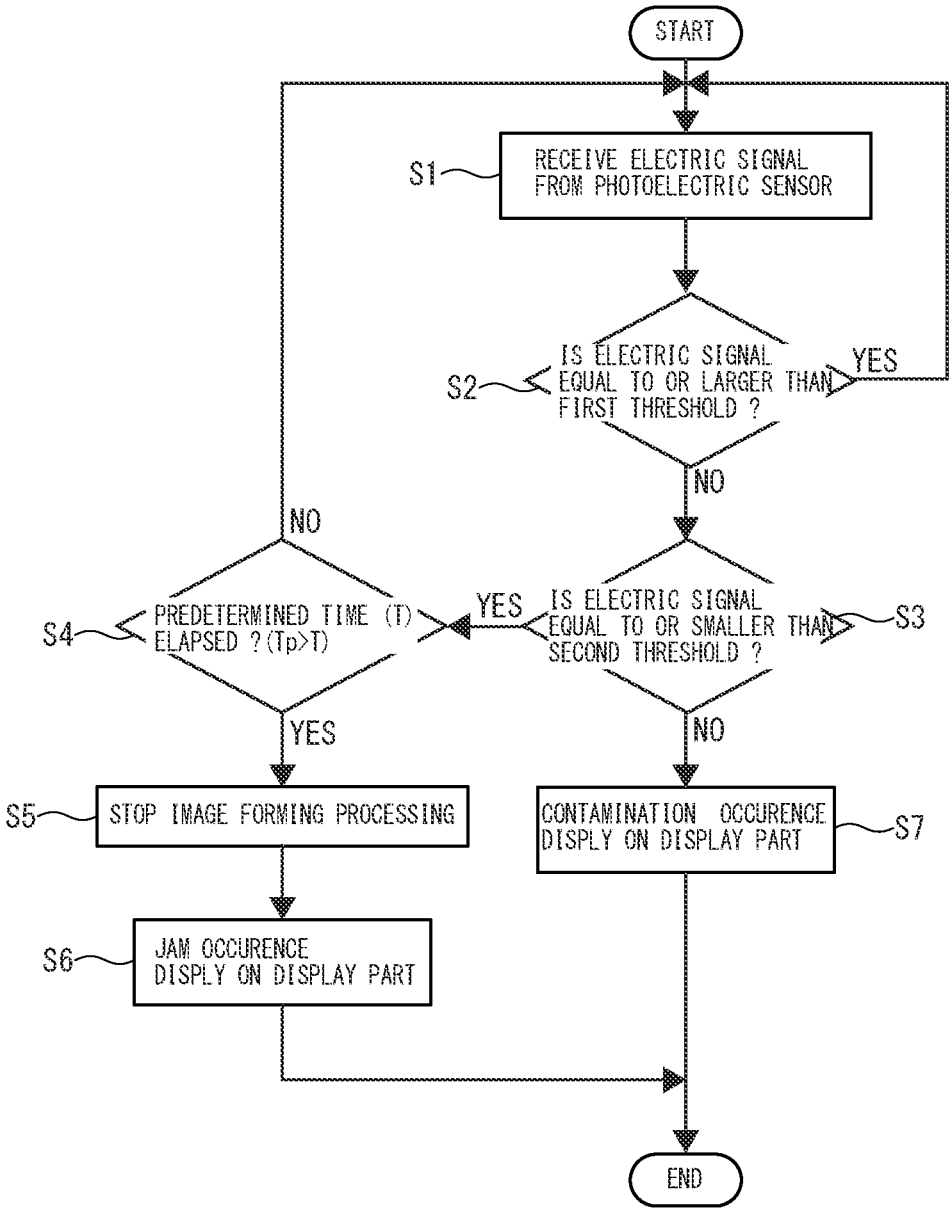
FIG. 7 is a flowchart showing a jam detection method in the image forming apparatus according to the embodiment of the present disclosure.

Next, with reference to FIG. 7, a jam detection method (a jam detection processing) using the jam detection part 35 will be described. FIG. 7 shows a flowchart showing the jam detection method. The controller 20 performs the jam detection method (the jam detection processing) in parallel with the image forming processing. The controller 20 performs the jam detection processing for all of the photoelectric sensors 36, but in the following description, the jam detection processing for one photoelectric sensor 36 will be described.

First, the controller 20 receives a voltage (an electric signal) output from the photoelectric sensor 36 (S1). The electric signal output from the photoelectric sensor 36 is analog-digital inverted and then stored in the storage part 22 or a cash memory of the arithmetic processing part 21. The controller 20 continues to receive the electric signal output from the photoelectric sensor 36 at a predetermined time interval from the start to the end of the image forming processing.

Next, the determination part 24 compares the stored electric signal with the first threshold T1 (S2). When the electric signal (the voltage) is equal to or larger than the first threshold T1 (Yes in S2), the determination part 24 determines that the sheet P does not exist on the conveyance belt 14 and the first to the third conveyance paths 6 to 8, and the processing returns to the reception of the output from the photoelectric sensor 36 (S1).

On the other hand, when the electric signal is smaller than the first threshold T1 (No in S2), the determination part 24 compares the electric signal with the second threshold T2 (S3). When the electric signal (the voltage) is equal to or smaller than the second threshold T2 (Yes in S3), the determination part 24 starts measuring a time, and determines whether the measured time (Tp) is a predetermined time (T) (S4). When the measured time (Tp) is the predetermined time (T) or shorter (Tp≤T (NO in S4)), the processing returns to the reception of the output of the photoelectric sensor 36 (S1), and the above determinations of S2 and S3 are executed again.

On the other hand, when the measured time (Tp) is longer than the predetermined time (T) (Tp>T (YES in S4)), the determination part 24 determines that the sheet jam occurs around the photoelectric sensor 36, and stores the determination result in the storage part 22. The controller 20 immediately stops (interrupts) the image forming processing (S5), and displays information (character strings, picture drawings, etc.) indicating the occurrence of sheet jam, the occurrence position of the sheet jam and the others on the display part 19 (S6).

The user checks the information displayed on the display part 19, opens the door provided in the housing 2 such as the cover 30, and removes the jammed sheet P (performs the jam treatment processing). The controller 20 determines that the jam treatment processing is performed based on the detection of the opening/closing of the door of the housing 2 and the output result of the photoelectric sensor 36, deletes the determination result of the occurrence of the sheet jam stored in the storage part 22, returns the display of the display part 19 to the normal display, and performs the interrupted image forming processing again.

Returning to the step (S3) where the electric signal output from the photoelectric sensor 36 is compared with the second threshold T2, when the electric signal (the voltage) is smaller than the first threshold T1 and exceeds the second threshold T2 (No in S3), the determination part 24 determines that the path facing surface area or the others 37 is contaminated, and stores the determination result in the storage part 22. The controller 20 causes the display part 19 to display information (character string, picture, etc.) indicating that maintenance of the path facing surface area or the others 37 is necessary (S7). When it is determined that the path facing surface area or the others 37 is contaminated, the controller 20 does not interrupt the image forming processing, but the controller 20 may interrupt the image forming processing. Further, when it is determined that the path facing surface area or the others 37 is contaminated, the controller 20 does not interrupt the new image forming processing, but the controller 20 may interrupt the new image forming processing.

The user checks the information displayed on the display part 19, opens the door provided in the housing 2 such as the cover 30, and carries out the maintenance of the conveyance belt 14 and the path facing surface area 37. The controller 20 determines that the maintenance is carried out based on the detection of the opening/closing of the door of the housing 2 and the output result of the photoelectric sensor 36, deletes the determination result of the occurrence of the contamination stored in the storage part 22, and returns the display of the display part 19 to the normal display.

When it is determined that the path facing surface area or the others 37 is contaminated even after the user carries out the cleaning, the controller 20 causes the display part 19 to display information indicating that the path facing surface area or the others 37 needs to be replaced. The work of replacing the path facing surface area or the others 37 is preferably performed by a specialized operator.

According to the image forming apparatus 1 according to the embodiment described above, by detecting that the output of the photoelectric sensor 36 is lower than the first threshold T1 even though the sheet P does not exist on the path facing surface area or the others 37, it can be estimated that the path facing surface area or the others 37 is contaminated with paper powder, ink or the like. Thus, it becomes possible to detect the time of cleaning for the path facing surface area or the others 37. As a result, it becomes possible to perform the maintenance, such as cleaning, of the path facing surface area or the others 37 before the occurrence of problems such as the sheet jam or the like that cause the driving of the image forming apparatus 1 to stop. In addition, it becomes possible to inhibit the sheet jam from being erroneously detected even when the sheet jam does not occur (erroneous detection). Furthermore, the photoelectric sensor 36 for the jam detection can also be used for contamination detection of the path facing surface area or the others 37. Thus, compared with a case where a dedicated sensor for detecting the contamination of the path facing surface area or the others 37 is separately provided, it becomes possible to make the structure around the path facing surface area or the others 37 simple and to reduce the manufacturing cost.

Further, according to the image forming apparatus 1 according to the present embodiment, it becomes possible to inform the user or the like through the display part 19 that the path facing surface area or the others 37 is contaminated and the maintenance such as cleaning is required. Thus, the user or the like can clean the path facing surface area or the others 37 before the occurrence of the sheet jam.

MODIFIED EXAMPLES

Figure 8:
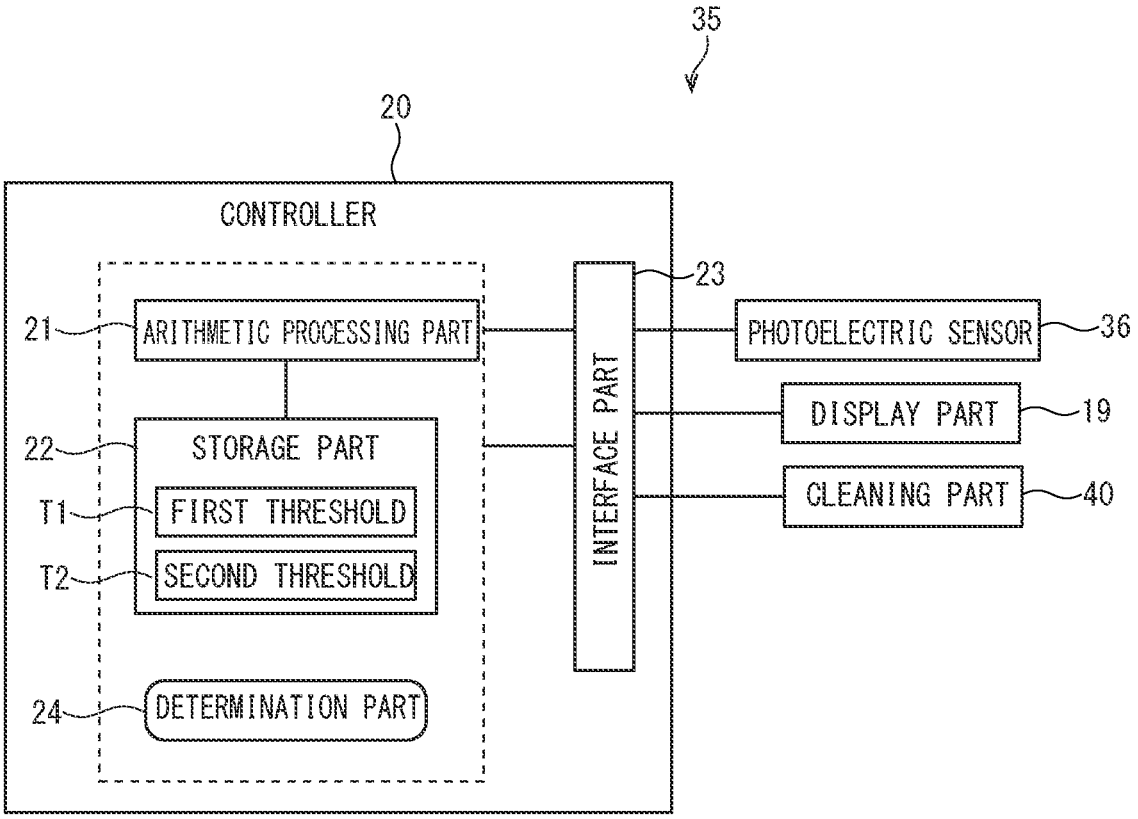
FIG. 8 is a block diagram showing a controller and the others in a first modified example of the image forming apparatus according to the embodiment of the present disclosure.
Figure 9:
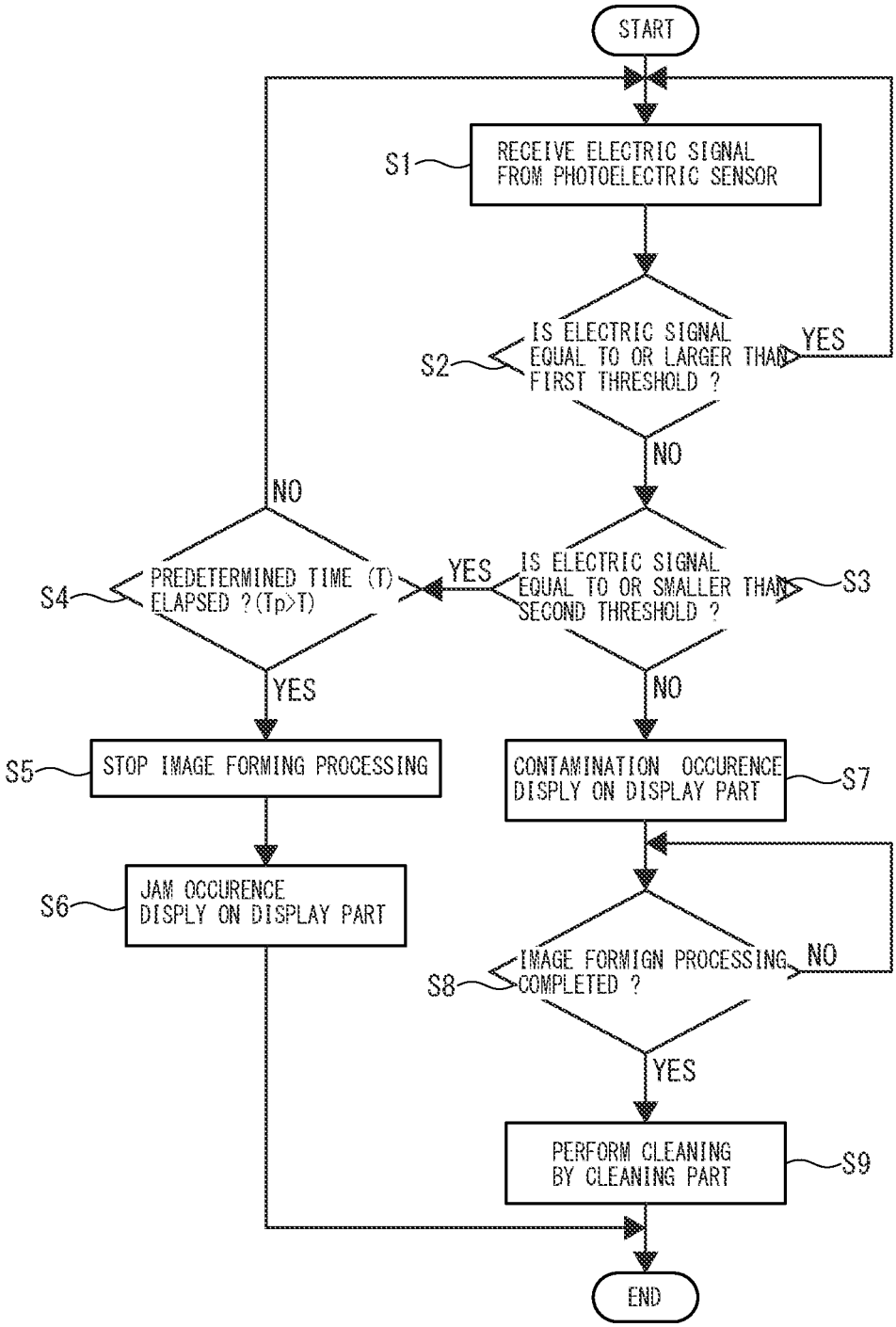
FIG. 9 is a flowchart showing a gam detection method in the first modified example of the image forming apparatus according to the embodiment of the present disclosure.
Figure 10:
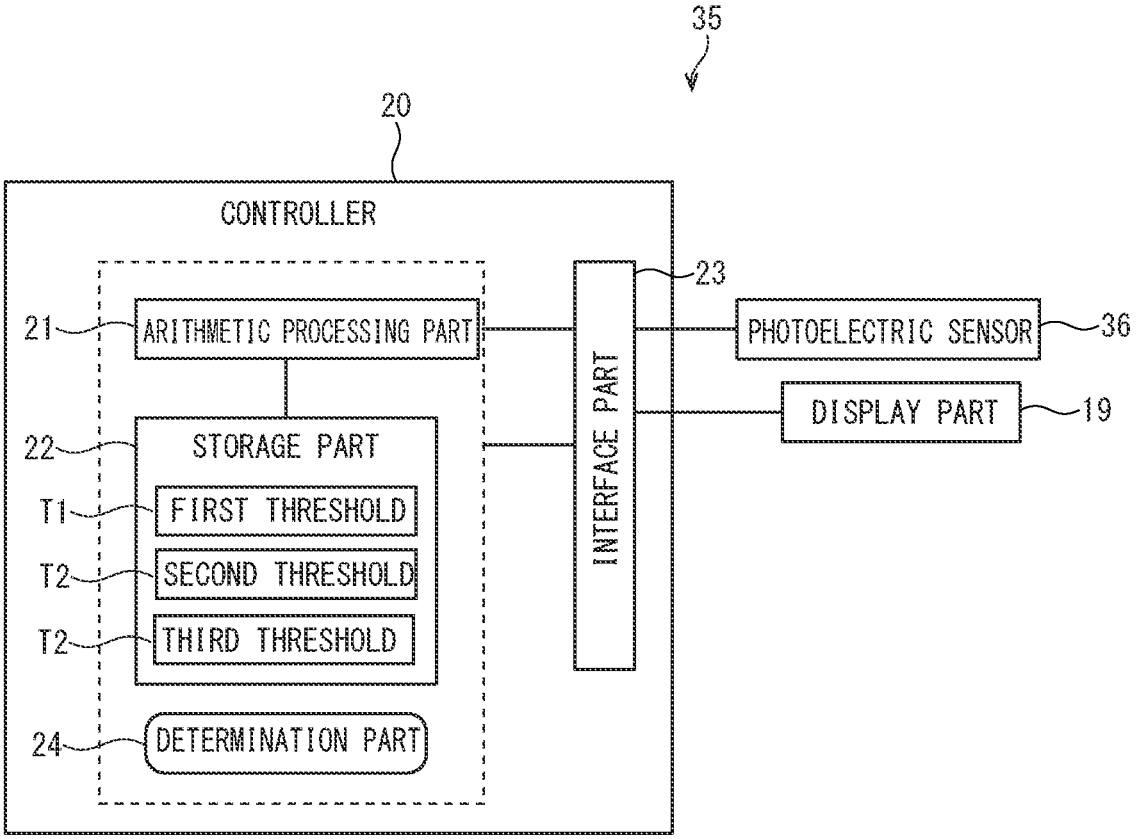
FIG. 10 is a block diagram showing a controller and the others in a second modified example of the image forming apparatus according to the embodiment of the present disclosure.
Figure 11:
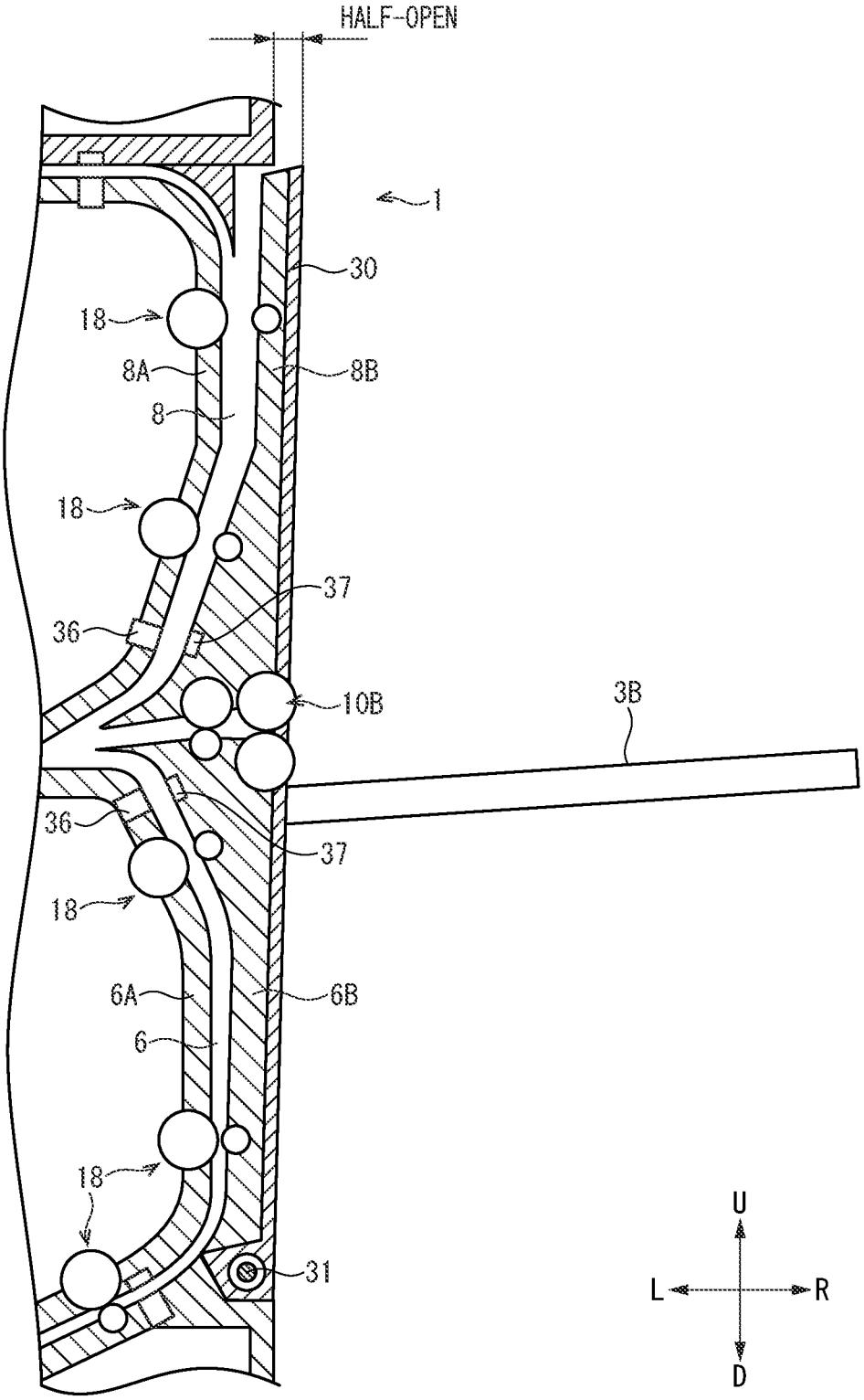
FIG. 11 is a sectional view showing the right side portion of the image forming apparatus in a cover half-open state, in the second modified example of the image forming apparatus according to the embodiment of the present disclosure.
Figure 12:
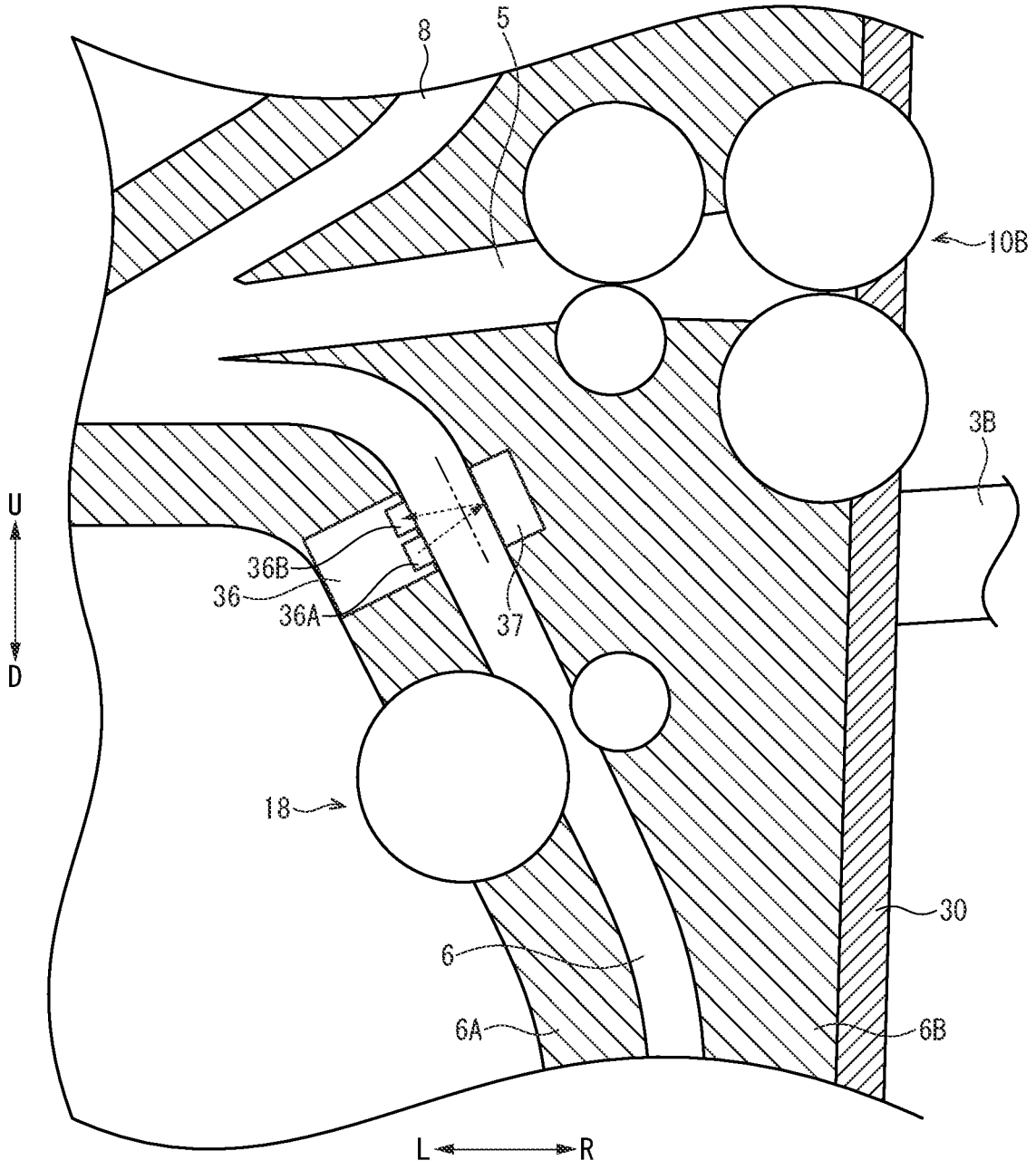
FIG. 12 is a sectional view showing the downstream side portion of the first conveyance path of the image forming apparatus in a cover half-opening state, in the second modified example of the image forming apparatus according to the embodiment of the present disclosure.
Figure 13:
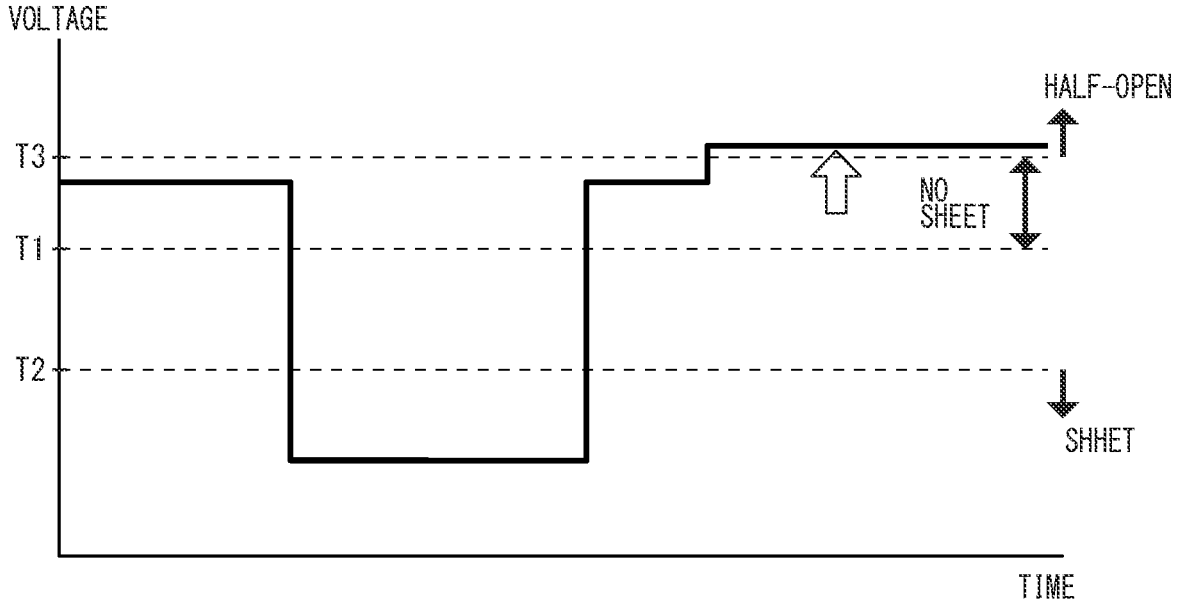
FIG. 13 is a graph showing an output of a photoelectric sensor in the image forming apparatus according to the second modified example of one embodiment of the present disclosure.
Figure 14:
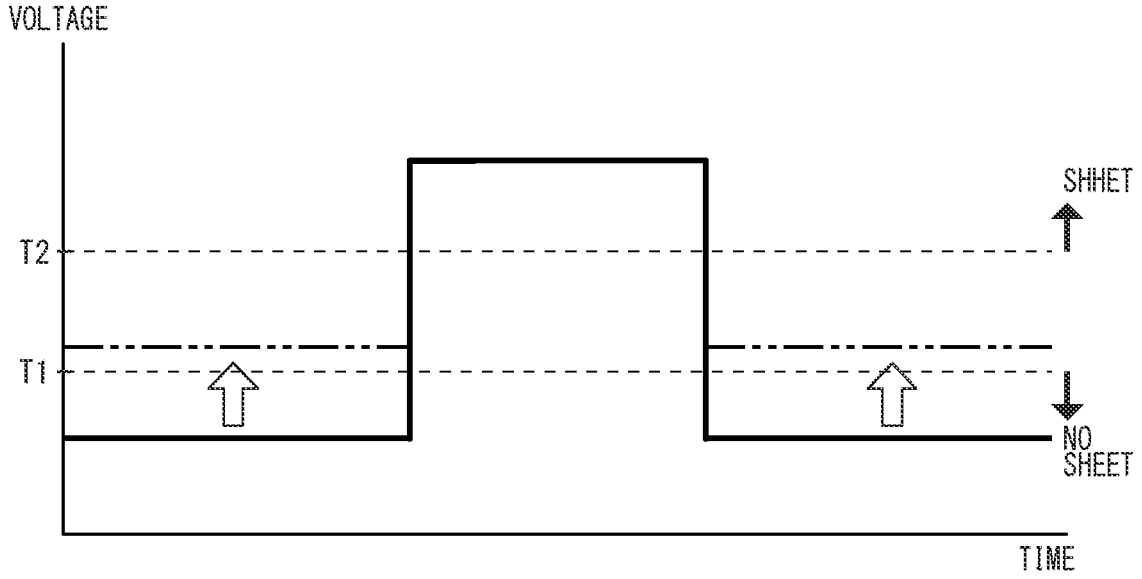
FIG. 14 is a graph showing an output of a photoelectric sensor in the image forming apparatus according to the third modified example of one embodiment of the present disclosure.

Next, modified examples of the image forming apparatus 1 according to the present embodiment will be described with reference to FIG. 8 to FIG. 14. FIG. 8 is a block diagram showing the controller 20 and the others of the image forming apparatus 1 according to the first modified example. FIG. 9 is a flowchart showing the jam detection method of the image forming apparatus 1 according to the first modified example. FIG. 10 is a block diagram showing the controller 20 and the others of the image forming apparatus 1 according to the second modified example. FIG. 11 is a sectional view showing a part of the right side portion of the image forming apparatus 1 according to the second modified example in a state where the cover 30 is half-opened. FIG. 12 is a sectional view showing the downstream side portion of the first conveyance path 6 of the image forming apparatus 1 according to the second modified example in a state where the cover is half-opened. FIG. 13 is a graph showing an output of the photoelectric sensor 36 of the image forming apparatus 1 according to the second modified example. FIG. 14 is a graph showing an output of the photoelectric sensor 36 of the image forming apparatus 1 according to the third modified example. In the description of the following modified examples, the same reference numerals are marked to the same or corresponding components (steps) of the image forming apparatus 1 according to the above-described present embodiment, and the description of the same or corresponding components (steps) is omitted.

First Modified Example

In the above-described image forming apparatus 1 according to the present embodiment, the user manually cleans the path facing surface area or the others 37. On the other hand, the image forming apparatus 1 according to the first modified example further includes, for example, a cleaning part 40 which cleans the path facing surface area or the others 37 (see FIG. 8).

The cleaning part 40 includes a cleaning member coming into contact with the surface of the conveyance belt 14 and the plane of the path facing surface area 37, and a drive part which rotates or reciprocates the cleaning member (not shown). The cleaning member may be, for example, a cleaning roller whose outer circumferential surface is made of a waste or a brush, or an elastically deformable blade (not shown). The drive part includes a drive source such as an electric motor and a solenoid, and a power transmission mechanism such as a gear train and a cam for connecting the drive source and the cleaning member (not shown). The drive part is electrically connected to the controller 20 (the interface part 23) and is controlled by the controller 20 to be operated. For example, the drive part moves the cleaning roller to a position in contact with the path facing surface area or the others 37, and rotates the cleaning roller around an axis. In addition, the drive part moves the blade to a position in contact with the path facing surface area or the others 37, and reciprocates and linearly moves the blade. In this way, dirt, such as paper dust and ink, adhering to the surface of the conveyance belt 14 and the plane of the path facing surface area 37 is removed.

As shown in FIG. 9, in the jam detection method (the jam detection processing), when the determination part 24 determines that the contamination occurs in the path facing surface area or the others 37 (NO in S3), and stores the determination result in the storage part 22. The controller 20 causes the display part 19 to display information indicating that maintenance of the path facing surface area or the others 37 is necessary (S7), and waits for completion of the image forming processing (NO in S8). When the image forming processing is completed (YES in S8), the controller 20 causes the cleaning part 40 to clean the path facing surface area or the others 37 (S9). After the cleaning by the cleaning part 40 is completed, the controller 20 deletes the determination result of the contamination occurrence stored in the storage part 22 and returns the display of the display part 19 to the normal display. If it is determined that the path facing surface area or the others 37 is contaminated even after the cleaning part 40 performs the cleaning, the controller 20 causes the display part 19 to display information indicating that the path facing surface area or the others 37 needs to be replaced.

In the image forming apparatus 1 according to the first modified example of the present embodiment described above, the cleaning part 40 can automatically clean the path facing surface area or the others 37. Thus, it becomes possible to omit the labor for the user to perform the cleaning work manually.

When it is determined that the contamination occurs in the path facing surface area or the others 37, the controller 20 may cause the display part 10 to display a button for selecting either cleaning by the cleaning part 40 or manual cleaning by the user (not shown).

In the image forming apparatus 1 according to the first modified example, the cleaning is performed such that the cleaning part 40 moves while contacting with the path facing surface area or the others 37, but the present disclosure is not limited to this. For example, the cleaning part may include a compressed air source for compressing air and a nozzle for blowing the compressed air to the path facing surface area or the others 37 (not shown). The cleaning part may blow the air to the path facing surface area or the others 37 to remove dirt adhering to the path facing surface area or the others 37.

Second Modified Example

The image forming apparatus 1 according to the second modified example is configured to detect a half-open state of the cover 30 by at least one of the path facing surface area 37 provided on the opposite side conveyance members 6B and 8B of the cover 30 and the photoelectric sensor 36 facing the path facing surface area 37. The half-open state of the cover 30 means a so-called half-door state in which the cover 30 cannot be opened by closing the side surface of the housing 2, but is not completely closed (see FIG. 11). In FIG. 11 and FIG. 12, as an example, the photoelectric sensor 36 provided on the downstream side of the first conveyance path 6 and the path facing surface area 37 detect the half-open state of the cover 30.

As shown in FIG. 10, the storage part 22 of the controller 20 stores a third threshold T3 in addition to the first threshold T1 and the second threshold T2. The third threshold value T3 is set to a value higher than the first threshold value T1 (see FIG. 13). In other words, the third threshold T3 is set to a value on the side opposite to the second threshold T2 with respect to the first threshold T1 and outside a predetermined range from the first threshold T1. The third threshold T3 is a threshold value for determining that the cover 30 is in the half-open state.

When the sheet P does not exist on the path facing surface area or the others 37 and the cover 30 is in the half-open state (see FIG. 11), a distance between the photoelectric sensor 36 and the path facing surface area 37 is slightly longer than that when the cover 30 is completely closed (see FIG. 12). The two-dotted chain line shown in FIG. 12 indicates the position of the path facing surface area 37 when the cover 30 is completely closed. Therefore, the reflected light reflected by the path facing surface area or the others 37 becomes weaker (the quantity of light decreases) than that when the cover 30 is completely closed, and as shown in FIG. 13, the photoelectric sensor 36 outputs a voltage exceeding the third threshold T3 set higher than the first threshold T1. The determination part 24 of the controller 20 determines that the cover 30 is in an open state when the voltage exceeds the third threshold T3. When the output of the photoelectric sensor 36 is equal to or larger than the first threshold T1 and equal to or less than the third threshold T3, the determination part 24 determines that the sheet P does not exist on the path facing surface area or the others 37.

The controller 20 receives the electric signal (the voltage) from the photoelectric sensor 36 before performing the image forming processing, and when the electric signal exceeds the third threshold T3, the determination part 24 determines that the cover 30 is in the half-open state. In this case, the controller 20 does not perform the image forming processing, and causes the display part 19 to display information indicating that the cover 30 is not completely closed. The user checks the information displayed on the display part 19, and closes the half-opened cover 30 completely.

The controller 20 performs the image forming processing when the electric signal is equal to or larger than the first threshold T1 and equal to or smaller than the third threshold T3, and executes the jam detection method (the jam detection processing) in parallel with the image forming processing. In principle, since the cover 30 is not opened during the image forming processing, the electric signal from the photoelectric sensor 36 does not exceed the third threshold T3 during executing the jam detection processing.

According to the image forming apparatus 1 according to the second modified example of the embodiment described above, the photoelectric sensor 36 used for detecting the sheet jam and detecting the contamination of the path facing surface area 37 can also be used for detecting the half-open state of the cover 30. Thus, the structure around the cover 30 can be made simple and the manufacturing cost can be reduced as compared with a case where a dedicated sensor for detecting the half-open state of the cover 30 is separately provided.

Further, according to the image forming apparatus 1 according to the second modified example, it becomes possible to inform the user or the like through the display part 19 that the cover 30 is not properly closed. Thus, the user or the like can properly close the half-opened cover 30.

The features of the image forming apparatus 1 according to the second modified example may be applied to the image forming apparatus 1 according to the first modified example.

Third Modified Example

In the image forming apparatus 1 according to the present embodiment (the first to the second modified examples are included.), the output (the voltage) of the photoelectric sensor 36 is increased or decreased in inverse proportion to the quantity of received light (the quantity of reflected light), but the present disclosure is not limited thereto. As shown in FIG. 14, the photoelectric sensor 36 in which the output (the voltage) increases or decreases in proportion to the quantity of received light (the quantity of reflected light) may be employed (a third modified example). That is, the photoelectric sensor 36 may be designed to increase the output (the voltage) as the quantity of received light (the quantity of reflected light) increases. In this design, the first threshold T1 is set to a value lower than the second threshold T2. The photoelectric sensor 36 outputs the voltage equal to or lower than the first threshold T1 when the sheet P does not exist on the path facing surface area or the others 37, and the photoelectric sensor 36 outputs the voltage equal to or higher than the second threshold value T2 when the sheet P exists on the path facing surface area or the others 37. When the photoelectric sensor 36 outputs the voltage higher than the first threshold T1 and lower than the second threshold T2, the determination part 24 determines that the contamination has occurred in the path facing surface area or the others 37. The third threshold T3 is set to a value lower than the first threshold T1 (not shown).

The jam detection method (the jam detection processing) described in the description of this embodiment (the first to the third modified examples are included, the same shall apply hereinafter) is only an example, and the order of each step (each step) may be changed within a range without contradiction.

Further, in the image forming apparatus 1 according to the present embodiment, although the cover 30 is provided on the right side surface of the housing 2, it is not limited thereto, and the cover may be provided on the left side surface, the front side surface, the rear side surface, the upper surface, etc. of the housing 2 in an openable and closable manner (not shown). When the cover constitutes any one of the first to the third conveyance paths 6 to 8 and the path facing surfaces 37 are provided in these covers, the half-open state of the cover can be detected from the output result of the photoelectric sensor 36.

In the image forming apparatus 1 according to the present embodiment, the path facing surface area 37 is provided on the opposite side conveyance members 6B and 8B of the cover 30, and the photoelectric sensor 36 is provided on the main body side conveyance members 6A and 8A, but the present disclosure is not limited thereto. Conversely, the photoelectric sensor 36 may be provided on the opposite side conveyance members 6B and 8B of the cover 30, and the path facing surface area 37 may be provided on the main body side conveying members 6A and 8A (not shown).

In the image forming apparatus 1 according to the present embodiment, the information (warning) such as the occurrence of sheet jam, the contamination of the path facing surface area 37, and the half-open state of the cover 30 is displayed on the display part 19, but the present disclosure is not limited thereto. For example, the image forming apparatus 1 may be provided with a speaker (not shown), and the controller 20 may execute a control to flow a warning sound or a sound corresponding to the above-described information from the speaker in addition to displaying the information on the display part 19.

Further, in the image forming apparatus 1 according to the present embodiment, although the turning shaft 31 of the cover 30 is provided in the horizontal direction in the lower portion of the housing 2, the turning shaft 31 may be provided in the upper-and-lower direction on either left side and right side of the housing 2 (the cover 30) (not shown).

The image forming apparatus 1 according to the present embodiment is a color printer, but it is not limited thereto, and may be a monochrome printer, a copying machine, a facsimile, etc. Although the image forming apparatus 1 is an ink-jet type printer, it is not limited thereto, and an electrophotographic type image forming apparatus (a printer, a copying machine, a facsimile, etc.) may be used, and it is also possible to detect that the path facing surface portion 37 is contaminated with a paper powder, a toner, or the like (not shown).

The description of the above embodiment shows one aspect of the image forming apparatus according to the present disclosure, and the technical range of the present disclosure is not limited to the above embodiment. The present disclosure may be modified, substituted, or modified in various ways without departing from the spirit of the technical idea, and the claims include all embodiments which may be included within the scope of the technical idea.

The invention claimed is:

1. An image forming apparatus comprising:

a reflective photoelectric sensor which emits light to an object to be detected, receives the light reflected on the object and outputs an electric signal corresponding to a quantity of the reflected light, the object to be detected including a facing surface area and a sheet on the facing surface area;

a controller which detects whether the sheet exists on the facing surface area in accordance with an output of the photoelectric sensor; and a cover mounted to a housing in an openable and closable manner and provided with the facing surface area or the photoelectric sensor, wherein the controller stores, as a threshold of the output of the photoelectric sensor, a first threshold for determining that the sheet does not exist on the facing surface area and a second threshold for determining that the sheet exists on the facing surface area, and determines that the facing surface area is contaminated to cause decreasing in the quantity of reflected light when the output of the photoelectric sensor is within a range between the first threshold and the second threshold, and determines that the cover is in a half-open state where the cover is not completely closed when the output of the photoelectric sensor is on an opposite side to the second threshold with respect to the first threshold and outside a predetermined range from the first threshold.

2. The image forming apparatus according to claim 1, further comprising a display part for displaying information, wherein when the controller determines that the cover is in the half-open state, the controller causes the display unit to display information indicating that the cover is not completely closed.

3. The image forming apparatus according to claim 1, wherein, the controller determines that a jam has occurred when a state where it is determined that the sheet exists on the facing surface area continues for a predetermined time.

4. The image forming apparatus according to claim 1, wherein the facing surface area is provided on a member constituting a conveyance path along which the sheet is conveyed or a conveyance belt on which the sheet is conveyed while attracted to the conveyance belt.

5. The image forming apparatus according to claim 1, wherein the facing surface area is processed to suppress reflection of light such that the light is more hardly reflected on the facing surface area than on the sheet.

6. The image forming apparatus according to claim 1, further comprising a display part, wherein the controller causes the display part to display information indicating that maintenance of the facing surface area is necessary when it is determined that contamination occurs in the facing surface area.

7. The image forming apparatus according to claim 1, further comprising a cleaning part for cleaning the facing surface area, wherein the controller causes the cleaning part to clean the facing surface area when it is determined that the facing surface area is contaminated.

* * * * *